US011821291B2

(12) United States Patent
Robertson

(10) Patent No.: US 11,821,291 B2
(45) Date of Patent: Nov. 21, 2023

(54) PERFORATING TORCH APPARATUS AND METHOD

(71) Applicant: Robertson Intellectual Properties, LLC, Mansfield, TX (US)

(72) Inventor: Michael C. Robertson, Mansfield, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

(21) Appl. No.: 17/840,377

(22) Filed: Jun. 14, 2022

(65) Prior Publication Data

US 2022/0412194 A1 Dec. 29, 2022

Related U.S. Application Data

(60) Provisional application No. 63/215,268, filed on Jun. 25, 2021.

(51) Int. Cl.
*E21B 43/116* (2006.01)
*E21B 43/119* (2006.01)
*E21B 43/114* (2006.01)

(52) U.S. Cl.
CPC ..... *E21B 43/116* (2013.01); *E21B 43/114* (2013.01); *E21B 43/119* (2013.01)

(58) Field of Classification Search
CPC ..... E21B 29/02; E21B 43/116; E21B 43/114; E21B 43/119; E21B 23/0417
See application file for complete search history.

(56) References Cited

U.S. PATENT DOCUMENTS

| | | | | |
|---|---|---|---|---|
| 4,446,920 | A * | 5/1984 | Woytek | E21B 43/114 166/55 |
| 8,020,619 | B1 * | 9/2011 | Robertson | E21B 29/04 166/54.5 |
| 10,787,864 | B1 * | 9/2020 | Robertson | E21B 31/002 |
| 11,396,783 | B2 * | 7/2022 | Younger | E21B 7/04 |
| 11,560,765 | B2 * | 1/2023 | Watkins | E21B 29/02 |
| 2010/0175879 | A1 * | 7/2010 | Robertson | E21B 43/11 166/298 |
| 2017/0335646 | A1 * | 11/2017 | Huang | E21B 43/11 |
| 2019/0063173 | A1 * | 2/2019 | Tallini | F42D 1/045 |
| 2019/0186243 | A1 * | 6/2019 | Huang | E21B 43/1185 |

* cited by examiner

*Primary Examiner* — Yong-Suk (Philip) Ro
(74) *Attorney, Agent, or Firm* — McCutcheon Joseph, PLLC

(57) ABSTRACT

A tubular perforating apparatus includes a nozzle section comprising a nozzle head located therein and adjacent a combustible fuel material. The nozzle head includes an internal cavity and a nozzle portion including an opening on one side of the nozzle portion that directs the cutting fluids out the internal cavity in a first radial direction to produce a reaction force on the apparatus in an opposite second radial direction. The reaction force moves the apparatus in the second radial direction to be against an inner wall of the tubular and temporarily anchors the apparatus against the inner wall. The nozzle head is movable via the pressure and the cutting fluids from a closed position within the nozzle section to an open position in which the nozzle portion protrudes out of the nozzle section so that the opening is exposed to the tubular for directing the cutting fluids onto the tubular.

19 Claims, 11 Drawing Sheets

Fig. 3A
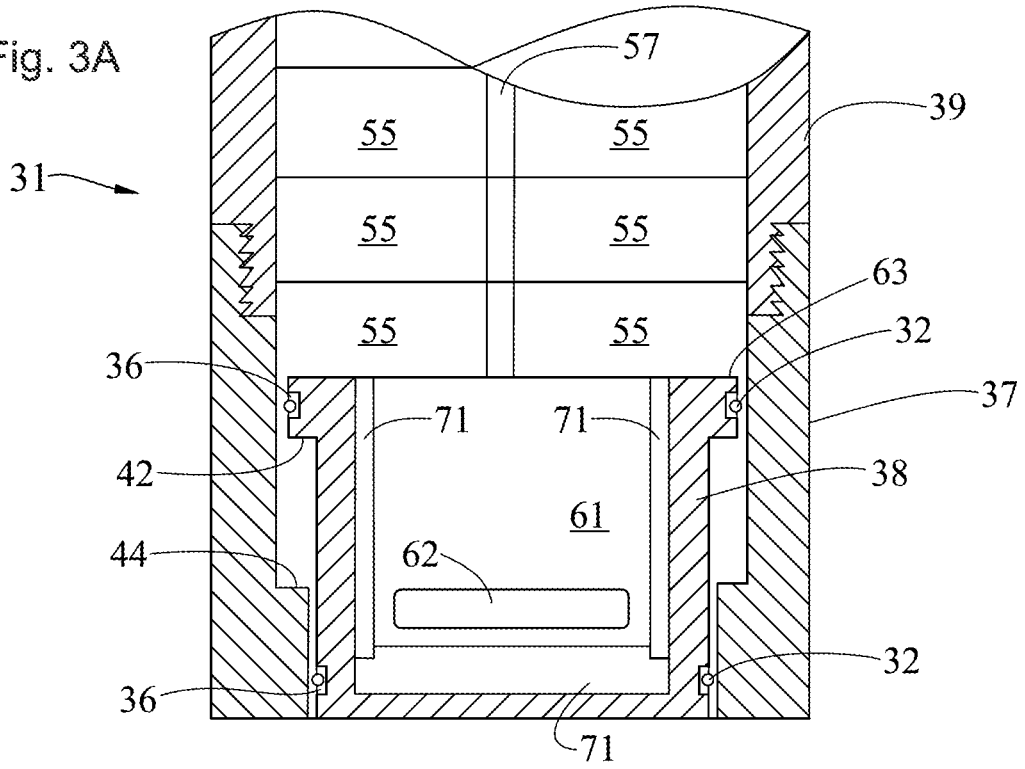
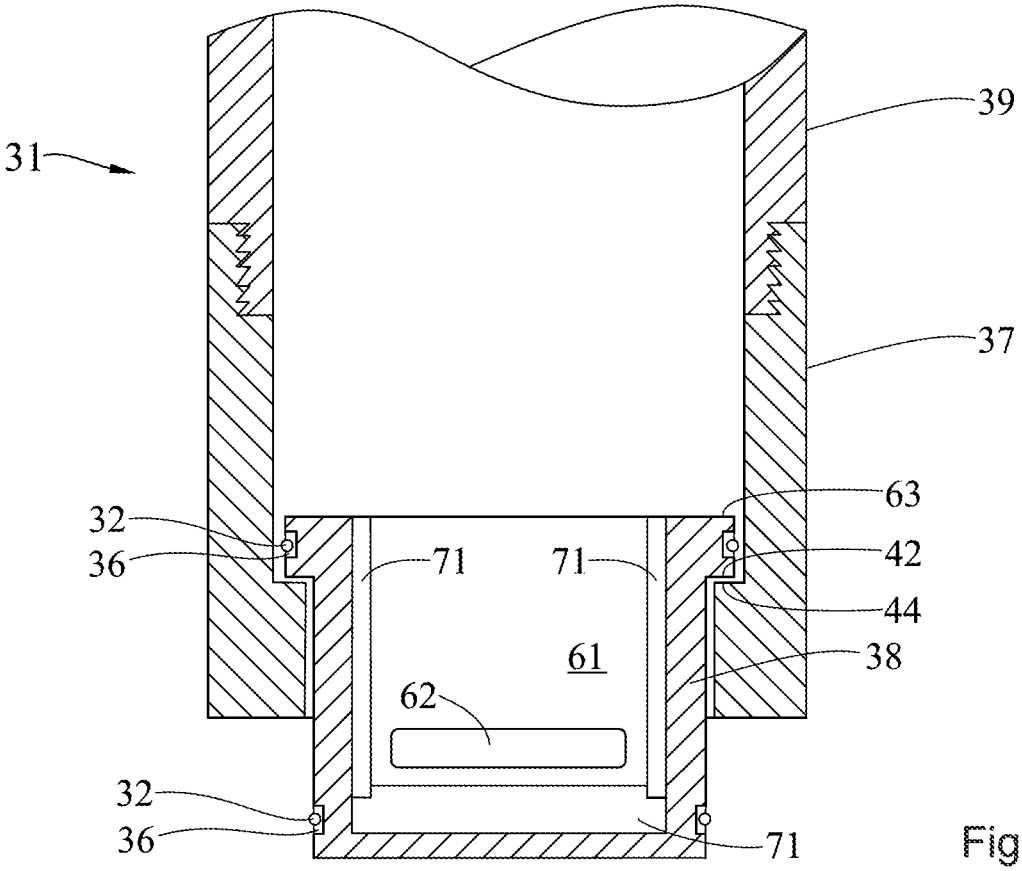
Fig. 3B

PERFORATING TORCH APPARATUS AND METHOD

CROSS REFERENCE TO RELATED APPLICATIONS

The present application is a non-provisional patent application that claims priority to U.S. Provisional Patent Application No. 63/215,268, having the title of "Perforating Torch Apparatus and Method," filed on Jun. 25, 2021. The disclosure of the prior application is hereby incorporated by reference herein in its entirety.

FIELD

The present invention relates, generally, to apparatuses and methods for using a perforator in the operation for cutting or perforating a tubular in a borehole.

BACKGROUND

In the oil and gas field, boreholes are drilled into the earth to create wells. Different types of tubulars may be lowered into the borehole. For instance, casing provides a lining along the walls of the borehole. A drill string is a length of tubular used to drill the borehole. Coiled tubing is also used to drill. After drilling, tubing is located within the casing so that oil and gas can be produced to the surface through the tubing. In addition, wells may be subjected to workover operations for maintenance.

It sometimes becomes necessary to cut the tubular at a location inside of the borehole. For instance, if coiled tubing is being used to drill, the end of the tubing may become stuck and cannot be removed from the borehole. Further, in a workover operation, downhole equipment may become stuck. Such a situation typically arises in boreholes having a cork screw profile. The tubing is generally cut near the stuck point, enabling most of the tubing to be withdrawn and salvaged for use in other wells. Radial cutting torches have been developed to cut downhole tubular.

There are situations, however, where the radial cutting torch does not work well. Such situations may arise when the tubular is blocked or closed below the radial cutting torch. For example, coiled tubing is typically run into a well with a check valve that prevents back flow of well fluids into the tubing. When the radial cutting torch is lowered into the tubing for a cutting operation, it is positioned some distance away from the check valve. The radial cutting torch uses hot combustion fluids directed radially out to cut the tubular. When ignited, the torch creates a pressure increase, or pressure wave, inside of the tubing. In an open tubular, the pressure wave propagates down the tubular to the bottom of the well. In a closed tubular however, the pressure wave reflects off of the check valve or other closure back to the torch. The pressure wave may jostle the torch, causing the torch to move from its position. Such movement may spread the hot combustion fluids over a larger area of the tubular, effectively distributing the cutting fluids over a larger area of the tubular to the point where the tubular may not be cut.

A conventional approach to such a problem has been to locate the torch at a sufficient distance away from the closure to mitigate the pressure wave. In small diameter tubular however, such as coiled tubing, this distance must be great, resulting in waste, as a long length of tubular must be left in the hole.

The present disclosure describes an apparatus and methods for cutting or perforating a pipe or other tubular close to a blockage or closure, thus reducing tubular waste, and for doing so without the use of anchoring devices.

SUMMARY

The present invention includes embodiments for providing an apparatus or methods usable for perforating a downhole pipe or other tubular (e.g., casing, production tubing, drill pipe, other conduits and tubulars). In an embodiment, the apparatus comprises a fuel section having a combustible fuel material (combustible material, e.g., thermite, thermite mixture) that is capable of producing cutting fluids for perforating, an igniter section that can be coupled to the fuel section and comprising an igniter that ignites the combustible fuel material (combustible material, e.g., thermite, thermite mixture) so as to produce cutting fluids and a pressure for doing work. The apparatus further comprises a nozzle section being in communication with the fuel section and comprising a nozzle head located therein and adjacent to the combustible fuel material (combustible material, e.g., thermite, thermite mixture). The nozzle head comprises an internal cavity and a nozzle portion, including at least one opening on one side of the nozzle portion that directs the cutting fluids out of the internal cavity, in a first radial direction, to produce a reaction force on the apparatus in a second radial direction that is opposite to the first radial direction. The reaction force, which moves the apparatus in the second radial direction against an inner wall of the downhole tubular, temporarily anchors the apparatus against the inner wall. The nozzle head is movable, via the pressure and the cutting fluids, from a closed position within the nozzle section to an open position in which the nozzle portion protrudes out of the nozzle section so that the at least one opening is exposed to the downhole tubular for directing the cutting fluids onto the downhole tubular.

In an embodiment, there can be at least two openings in the nozzle portion, wherein the at least two openings can be spaced circumferentially relative to each other and the at least two openings can direct cutting fluids along parallel trajectories. In an embodiment, the nozzle section can comprise an internal no-go shoulder, and the nozzle head can comprise an outer shoulder that is configured to contact the internal no-go shoulder, after the igniter ignites the combustible fuel material (combustible material), to move the nozzle head relative to the nozzle section. In an embodiment, the nozzle head comprises at least one seal around a perimeter of the nozzle head.

In another embodiment, a method of perforating a tubular having a closure comprises the step of positioning a perforator in the tubular within a distance to the closure, wherein the perforator comprises a movable nozzle head located within a nozzle section. The movable nozzle head comprises an internal cavity and at least one opening on one side of the movable nozzle head. The steps of the method continue by operating the perforator to produce pressure and cutting fluids in the internal cavity to move at least a portion of the movable nozzle head out of the nozzle section so that the at least one opening is exposed to the tubular, and directing the cutting fluids in a first radial direction toward the tubular, wherein the production of cutting fluids produces a reaction force and a pressure wave in the tubular that is reflected off of the closure and back to the perforator. The steps of the method can further include moving the perforator, via the reaction force, against the tubular, and temporarily anchoring the perforator against the tubular while the reflected pressure wave impinges on the perforator. The method steps can further include continuing to produce cutting fluids in the first radial direction, while the perforator is anchored against the tubular by the reaction force, to create an opening in the tubular; positioning a radial cutter in the tubular within the distance to the closure, with the opening located between the radial cutter and the closure; and operating the radial cutter to radially cut the tubular.

In an embodiment, the reaction force is a predetermined reaction force having a magnitude that is based on the distance of the perforator from the closure. In an embodiment, the reaction force is a predetermined reaction force having a magnitude that is based on a clearance between the perforator and the tubular.

In an embodiment, the tubular has a drilling fluid with a density, and the reaction force is a predetermined reaction force having a magnitude that is based on the density of the drilling fluid. In an embodiment, the tubular has a wall thickness, and the opening has a size, and the reaction force is a predetermined reaction force having a magnitude that is based on the tubular wall thickness and the size of the opening.

In an embodiment, the nozzle section comprises an internal no-go shoulder, and the nozzle head comprises an outer shoulder, and the outer shoulder contacts the internal no-go shoulder after the nozzle head is moved a predetermined distance relative to the nozzle section to prevent the nozzle head from completely exiting the nozzle section.

In an embodiment, the nozzle head is a first nozzle head, and the method further comprises replacing the first nozzle head with a second nozzle head after creating the opening. In an embodiment, the second nozzle head includes a different opening than the at least one opening of the first nozzle head.

In a further embodiment, an apparatus for cutting a downhole tubular comprises a perforating tool that comprises a perforating igniter section, a perforating fuel section, and a perforating nozzle section. The perforating fuel section can contain combustible fuel material (combustible material) capable of producing pressure and cutting fluids, and the perforating igniter section can contain an igniter that ignites the combustible fuel material (combustible material) so as to produce cutting fluids for doing work. The perforating nozzle section can be in communication with the fuel section and can comprise a nozzle head that includes an internal cavity, and a nozzle portion that includes an opening on one side of the nozzle portion that directs the cutting fluids out of the internal cavity in a first radial direction to produce a reaction force on the perforating tool in a second radial direction that is opposite to the first radial direction, wherein the reaction force can move the perforating tool in the second radial direction, and against an inner wall of the downhole tubular, and temporarily anchor the perforating tool against the inner wall. The nozzle head is movable, via the pressure and the cutting fluids, from a closed position within the nozzle section to an open position, in which the nozzle portion protrudes out of the nozzle section so that the opening is exposed to the downhole tubular for directing the cutting fluids onto the downhole tubular. In addition, the embodiment includes a cutting torch, which comprises a cutting igniter section, a cutting fuel section, and a cutting nozzle section. The cutting fuel section of the cutting torch contains combustible fuel material (combustible material) capable of producing cutting fluids, and the cutting igniter section has a second igniter that ignites the combustible fuel material (combustible material) in the cutter fuel section. The cutting nozzle section is in communication with the cutting fuel section for discharging the cutter cutting fluids radially outward.

BRIEF DESCRIPTION OF THE DRAWINGS

FIG. 3A is a cross-sectional close-up view of the nozzle head of the perforating tool in a first position, according to an embodiment.

FIG. 3B is a cross-sectional close-up view of the nozzle head of the perforating tool in a second position, according to an embodiment.

DETAILED DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "uphole", "downhole", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
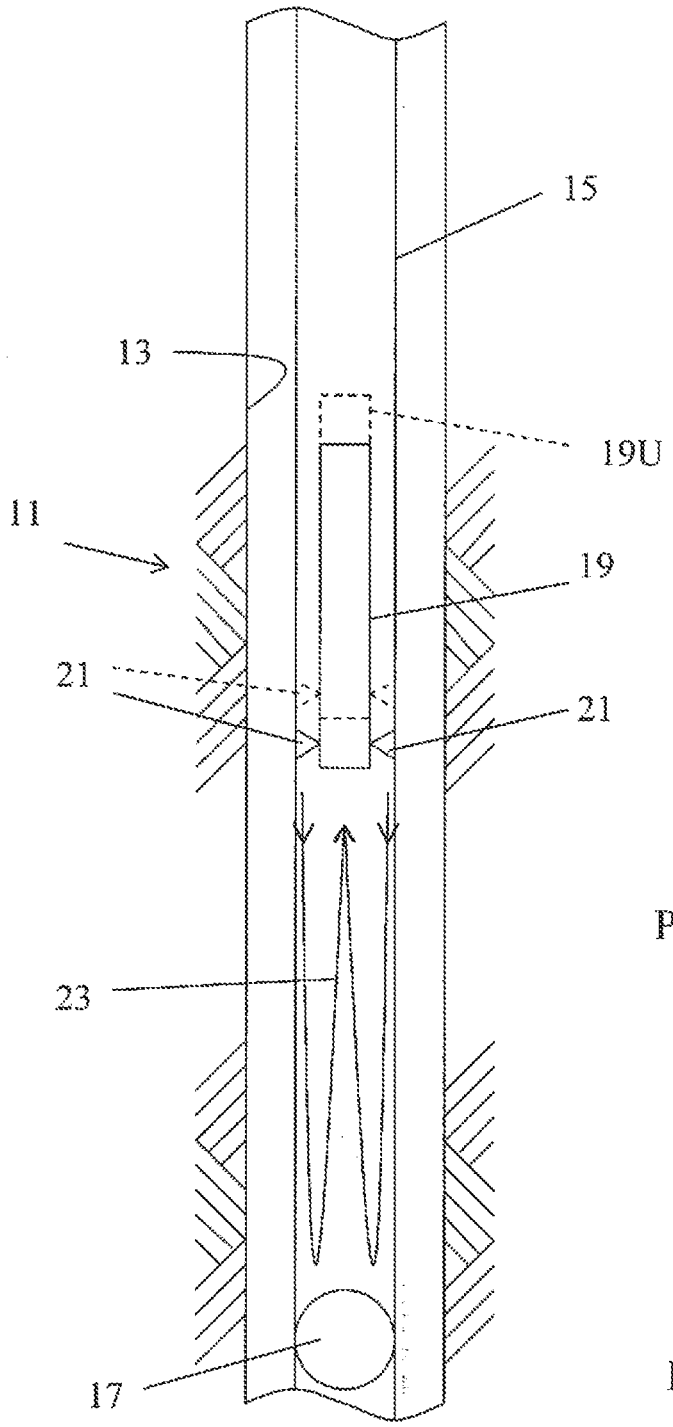
PRIOR ART Fig. 1
FIG. 1 is a cross-sectional view of a borehole showing a conventional cutting torch operating in the closed tubular.

FIG. 1 illustrates a conventional technique for cutting a tubular having a closure, and a problem associated therewith. FIG. 1 shows a borehole or well 11 that is lined with a casing 13. Tubing 15 is run into the borehole 11, and has a closure 17 located therein. The closure 17 can be a check valve, a flapper valve, a plug, a collapsed plug, etc. When the tubing 15 is to be cut, a cutting torch 19 is lowered into the tubing 15 to a location above the closure 17. For illustrative purposes, the tubular on which the cutting torch 19 is suspended is not shown. When the torch 19 is initiated, hot combustion fluids 21 are directed radially out from the torch 19. These combustion fluids create a pressure wave 23 that propagates down the tubing 15. Another pressure wave propagates up the tubing 15 to the surface, but is not a factor. The pressure wave 23 propagating down reflects, or bounces, off of the closure 17 back to the torch 19. The reflected pressure wave 23 impinges on the torch 19, moving the torch 19 up to a position 19U, as shown by the dashed lines in FIG. 1. Likewise, the hot combustion fluids also move up to contact a new area of the tubing 15. The cutting fluids are thus distributed over a relatively wide band at the tubing 15, which effectively reduces the cutting ability of the cutting fluids.

The present disclosure implements a perforating tool before a cutting torch is used. The perforating tool cuts an opening in the tubular or tubing 15 at a location above the closure 17. Once the tubular is opened, the cutting torch is then used to cut the tubular. The pressure wave created by the cutting torch is vented through the opening. Any reflection of the pressure wave back toward the torch is attenuated so that the torch does not move. This results in a successful cutting of the tubing 15. The perforating tool also creates a pressure wave when it creates the opening. This pressure wave is reflected off of the closure back to the tool. However, the perforating tool uses the reaction force of the cutting fluids it generates to anchor the tool against the tubing and remain stationary even in the face of encountering the reflected pressure wave. In the following description, the perforating tool will be described first, followed by a description of the cutting torch. A description of the operation of the perforating tool and cutting torch will then be provided.

Figure 2A:
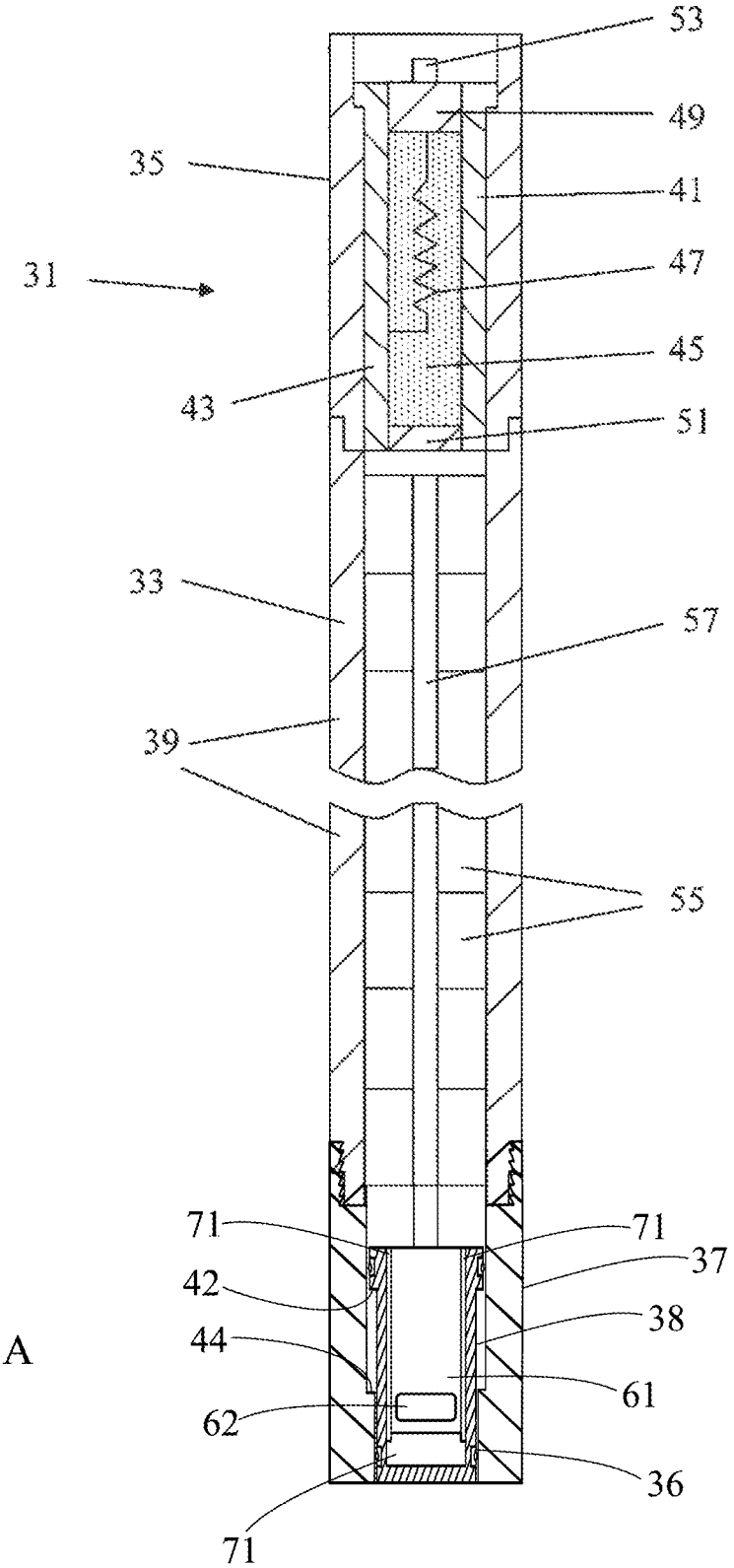
FIG. 2A is a longitudinal cross-sectional view of the perforating tool according to an embodiment.

FIG. 2A shows a preferred embodiment of the perforating tool 31. The tool may comprise an elongated tubular body 33 which has an ignition section 35, a nozzle section 37 and a fuel section 39 between the ignition section 35 and the nozzle section 37. In an embodiment, the tubular body 33 can be made of three components coupled together by threads. Thus, the fuel section 39 may be made from an elongated tube or body member, the ignition section 35 may be made from a shorter extension member, and the nozzle section 37 may be made from a shorter head member.

The ignition section 35 contains an ignition source 41. In the preferred embodiment, the ignition source 41 is a thermal generator. The thermal generator 41 may be a self-contained unit that can be inserted into the extension member. The thermal generator 41 has a body 43, flammable material 45 and a resistor 47. The ends of the tubular body 43 are closed with an upper end plug 49, and a lower end plug 51. The flammable material is located in the body between the end plugs. The upper end plug 49 has an electrical plug 53 or contact that connects to an electrical cable (not shown). The upper plug 49 is electrically insulated from the body 43. A resistor 47 is connected between the electrical plug 53 and the body 43. The flammable material 45 may be a non-explosive material, e.g., thermite, or modified thermite, mixture. The thermite mixture includes a metal and an oxidizer (e.g., a powdered or finely divided metal and a powdered metal oxide or other oxidizer). The metal can include aluminum, magnesium, etc. The metal oxide can include cupric oxide, iron oxide, aluminum oxide, etc. In an embodiment, the thermite mixture is cupric oxide and aluminum. When ignited, the flammable material produces an exothermic reaction. The flammable material has a high ignition point and is thermally conductive. The ignition point of cupric oxide and aluminum is about 1200 degrees Fahrenheit. Thus, to ignite the flammable material, the temperature must be brought up to at least the ignition point and preferably higher. In an embodiment, the ignition point of the thermite mixture is as low as 900 degrees Fahrenheit.

Figure 2B:
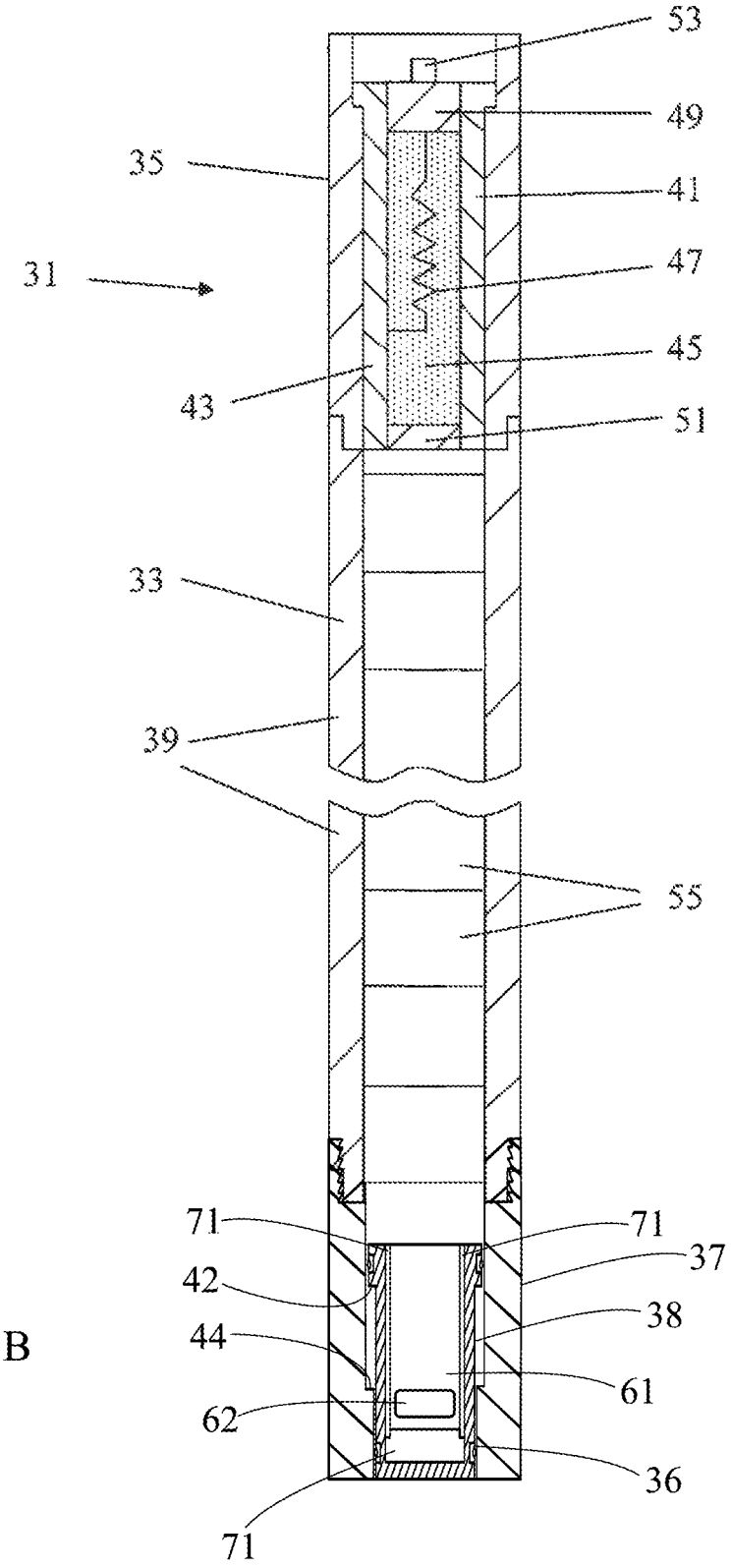
FIG. 2B is a longitudinal cross-sectional view of the perforating tool according to another embodiment.

The fuel section 39 contains the fuel. The fuel may in some embodiments be combustible material in the form of a solid, a liquid, or a gel. The combustible material may be non-explosive fuels such as thermites, modified thermites (containing gasification agents) or thermite mixtures containing binders, low explosives such as propellants and pyrotechnic compositions or modified liquid or gelled fuels with metal and/or metal oxide additives. In some embodiments, the non-explosive combustible fuels may be in the form of single or multiple stacked combustible pellets 55, e.g., thermite pellets. The pelletized fuel may be installed within the assembly prior to shipping. In other embodiments, the pelletized fuel may be installed in the assembly at the work site so that the mass of fuel can be adjusted to suit the specific well conditions, constraints, and operational requirements such as hydrostatic pressure or changes to the cutting requirements. In the preferred embodiment, the fuel can be made up of a stack of pellets 55 which are donut or toroidal shaped. When stacked, the holes in the center of the pellets 55 are aligned together. The holes can be filled with loose combustible fuel material 57, which may be of the same material as the pellets 55. When the combustible fuel material combusts, it generates pressure and hot combustion fluids that are sufficient to cut through a tubular wall, if properly directed. The combustion fluids comprise gasses and liquids. In the embodiment shown in FIG. 2B, the pellets 55 may be provided without the loose combustible fuel material 57.

The pellets 55 can be adjacent to, and abut, a nozzle head 38 that is provided in the nozzle section 37. The nozzle head 38 can comprise an internal cavity 61 that can be lined with a heat resistant liner 71, which may be formed of carbon in an embodiment. The liner 71 protects the nozzle head 38 from the cutting fluids generated by the fuel section. The liner 71 can be perforated at a nozzle opening 62, and the liner 71 can comprise a cylindrical side wall and a bottom wall. The nozzle opening 62 can be formed through the nozzle head 38 for providing passage from the internal cavity 61 to outside of the nozzle head 38, and can allow communication between the interior and exterior of the nozzle section 37. The nozzle opening 62 opens in a plane perpendicular to a central axis of the perforating tool 31, as shown in FIG. 3A. In the embodiments shown in FIGS. 2A, 2B, 3A and 3B, the nozzle opening 62 is elongated in a direction perpendicular to the central axis 31 of the perforating tool, so as to have a substantially rectangular shape. Alternatively the nozzle opening 62 may have a height greater than its width. In still other embodiments, the nozzle opening 62 can be square or circular, or may comprise another polygonal shape. The nozzle head 38 may further include seals 32, such as O-rings, located in respective slots 36 around a perimeter of the nozzle head 38 is shown in FIGS. 3A and 3B. The seals 32 and liquid pressure in the internal cavity 61 can initially hold the nozzle head 38 within the nozzle section 37 of the perforating tool 31, as shown in FIGS. 2A and 3A. Fluid from the borehole 11 can flow into the internal cavity 61 by way of the nozzle opening 62 when the perforating tool 31 is located in the borehole 11. As shown in FIG. 3A, the nozzle section 37 may include an internal no-go shoulder 44 for contact with an outer shoulder 42 on a radial protrusion 63 of the nozzle head 38. The outer shoulder 42 of the nozzle head 38 is configured to contact the internal no-go shoulder 44 after the nozzle head 38 is moved relative to the nozzle section 37 during a cutting operation, as discussed below and shown in FIG. 3B.

When the fuel pellets 55 are ignited, the pressure of combustion fluids generated by the ignited fuel enters the internal cavity 61 of the nozzle head 38 and forces the nozzle head 38 downward from a first position within the nozzle section 37, as shown in FIG. 3A, to a second position shown in FIG. 3B, in which at least a portion of the nozzle head 38, having the nozzle opening 62, protrudes out of the nozzle section 37. The nozzle opening 62 in the second position is thus exposed to the tubing 15 for passage of the combustion fluids out of the nozzle opening 62 to perforate the tubing 15. The fuel may be located only on one side or end of the nozzle section 37. This allows the nozzle section 37 to be brought as close as possible to the closure 17 and even into contact with the closure 17.

Figure 4A:
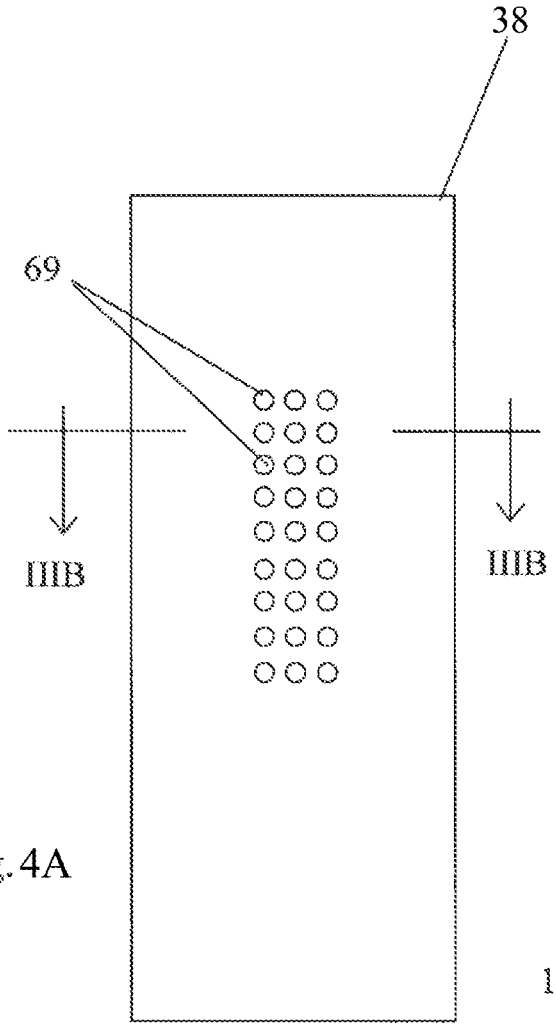
FIG. 4A is an elevational view of the pattern of openings on the perforating tool, according to an embodiment.
Figure 8:
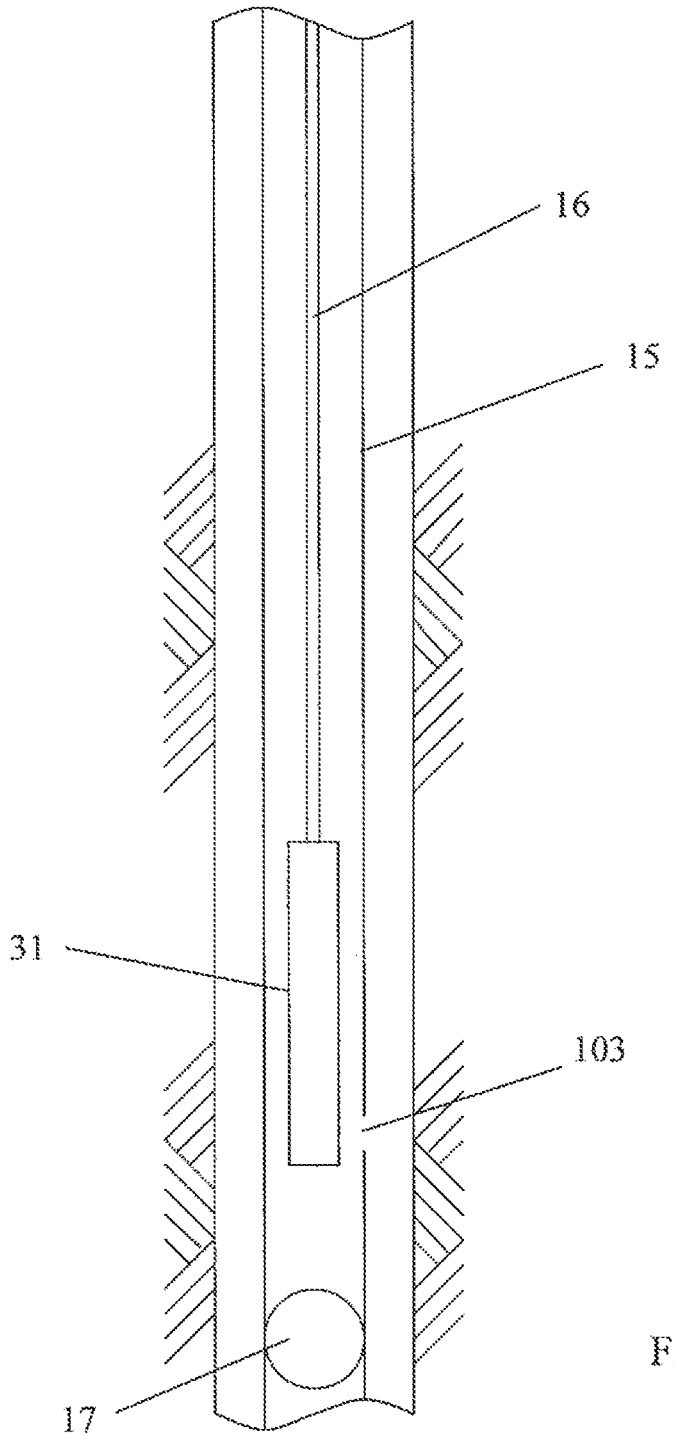

The nozzle head 38 in the embodiment shown in FIGS. 2A to 3B includes a single nozzle opening 62. In an alternative embodiment, plural nozzle openings 69 are provided as shown in FIG. 4A. The nozzle openings 69 may be arranged to produce cutting fluids 21 with parallel trajectories, as shown in FIG. 4C. This is accomplished by having the nozzle openings 69 formed into the nozzle section 38 in a parallel manner, instead of a radial manner. FIG. 4D shows dashed lines 69A, which are the central axes of the nozzle openings 69. As can be seen, these lines 69A are parallel and do not converge to a center in the nozzle section 38. Having the nozzle openings 69 produce cutting fluids 21 with parallel trajectories produces a stronger reaction force 101 (see FIG. 4C). In addition, the parallel trajectories produce a cleaner opening 103, as shown in FIG. 8. If the cutting fluids 21 had radial trajectories, then interstitial spaces in the tubing 15 may be left as a result of cutting fluids 21 being spread too far apart.

Figure 4B:
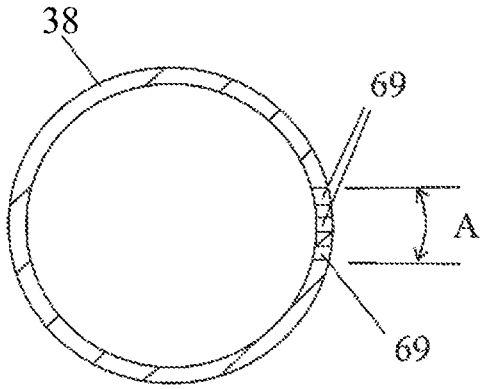
FIG. 4B is a cross-sectional view taken through lines IIIB-IIIB of FIG. 3A.
Figure 4D:
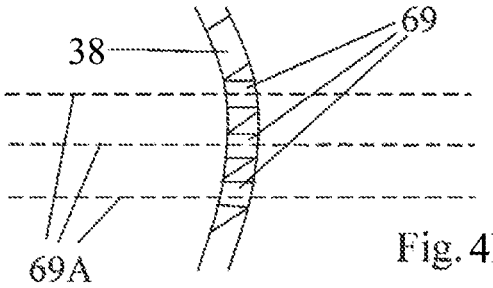
FIG. 4D is a detail view of the openings in the nozzle section.
Figure 4C:
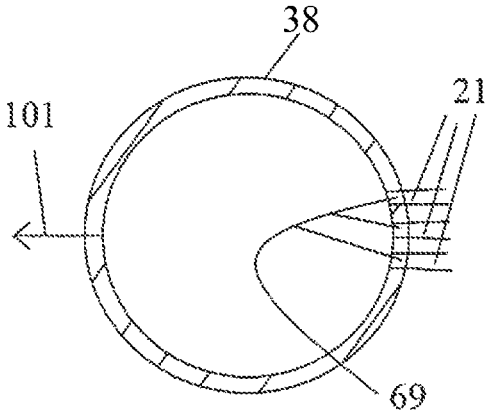
FIG. 4C is a cross-sectional view similar to FIG. 3B, showing the discharge of combustion fluids through openings.

In the embodiment shown in FIGS. 4A-4D, the nozzle openings 69 are arranged in the vertical pattern shown, with rows and columns. Typical sizes of the nozzle openings 69 can range from 0.198-0.476 centimeters (0.078-0.1875 inches) in diameter. The nozzle openings 69 have a circumferential arc "A" that can range from a single opening up to 40 degrees, as shown in FIG. 4B. The nozzle openings 69 can be rectangular in shape, having a height greater than a width. Alternatively, the openings can be square or circular (as shown), or may have another polygonal shape.

Figure 5:
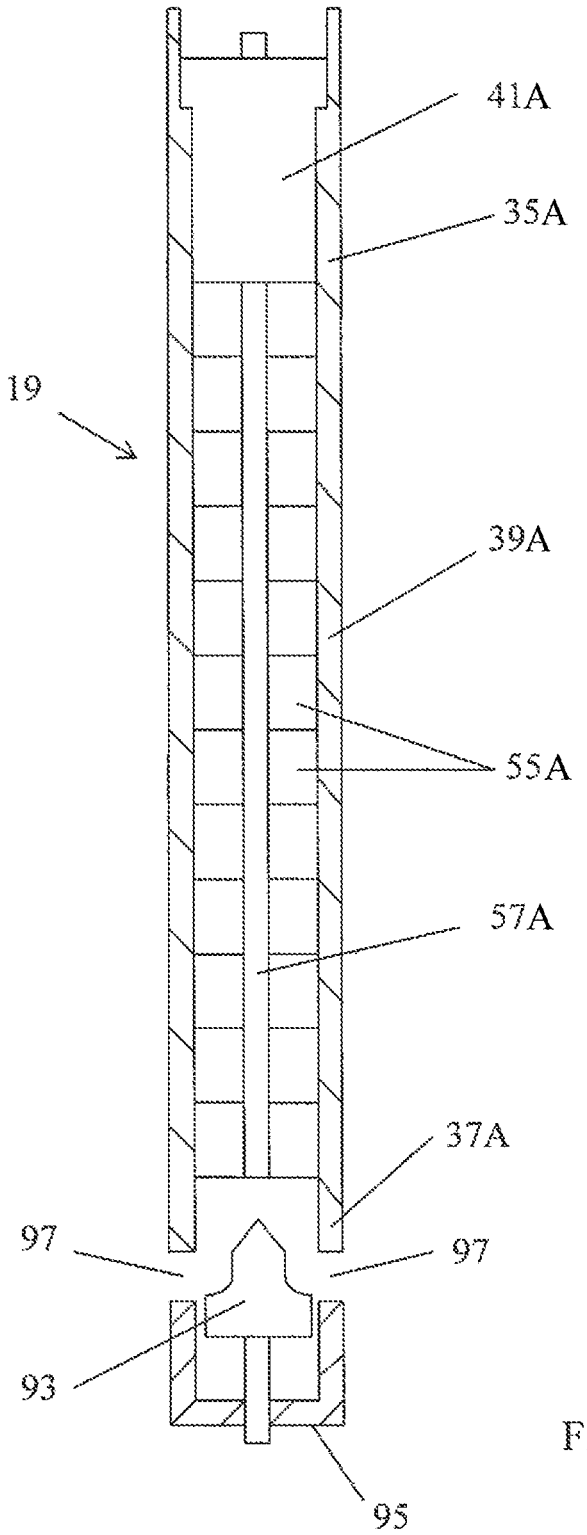
FIG. 5 is a longitudinal cross-sectional view of a radial cutting torch.

FIG. 5 illustrates an embodiment of a radial cutting torch 19. The radial cutting torch 19 may be similar to the perforating tool 31 in that the radial cutting torch 19 has an ignition section 35A, a fuel section 39A and a nozzle section 37A. The ignition section 35A and the fuel section 39A may be substantially similar to those sections of the perforating tool 31. For instance, the ignition section 35A may include an ignition source 41A, and the fuel section 39A may include pellets 55A and combustible fuel material 57A. However, the fuel section 39A of the radial cutting torch 19 will generally contain more fuel than the fuel section 39 of the perforating tool 31. The nozzle section 37A of the radial cutting torch 19 is different than the nozzle section 37 of the perforating tool 31. In this regard, the nozzle section 37A of the radial cutting torch 19 includes a diverter 93 that diverts the combustion fluids radially out in a 360 degree pattern. A sleeve 95 or end cap is provided to close the bottom end of the radial cutting torch 19. The sleeve 95 slides along a shaft extending below the diverter 93. When the combustion fluids impact the sleeve 95, the sleeve 95 slides down to create a 360 degree opening 97 that is aligned with the diverter 93. Thus, the hot combustion fluids are directed radially out from the radial cutting torch 19.

Figure 6:
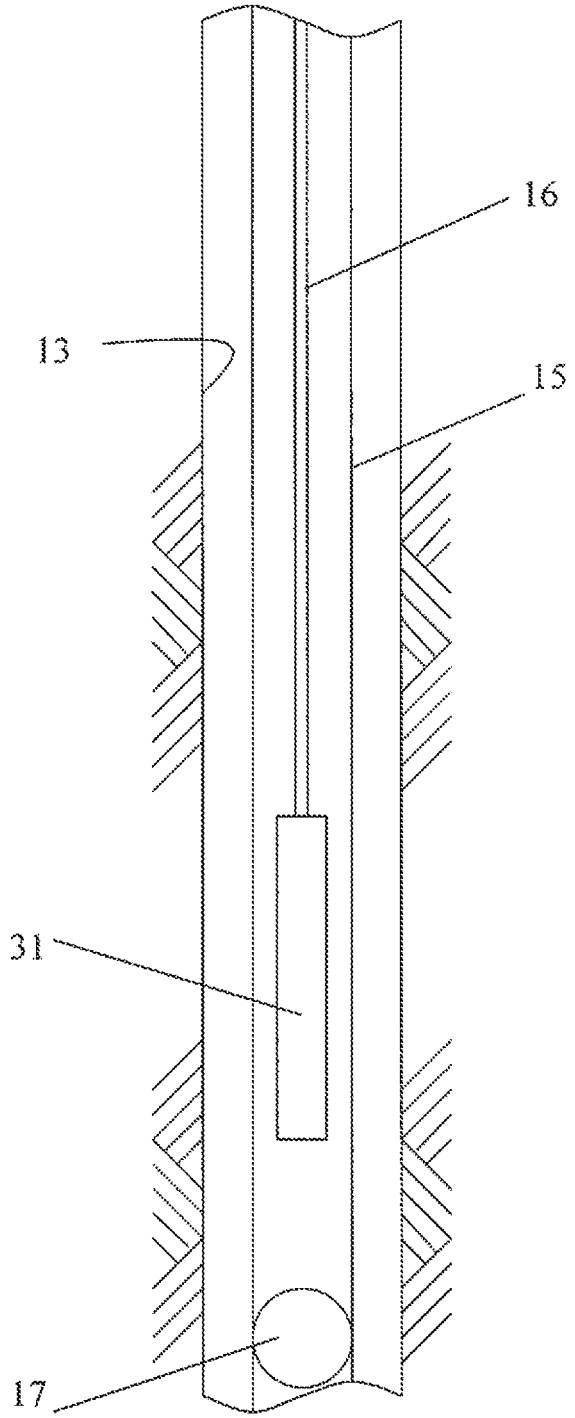
FIGS. 6-9 illustrate use of the perforating tool and cutting torch in closed tubular, according to an embodiment.
Figure 7:
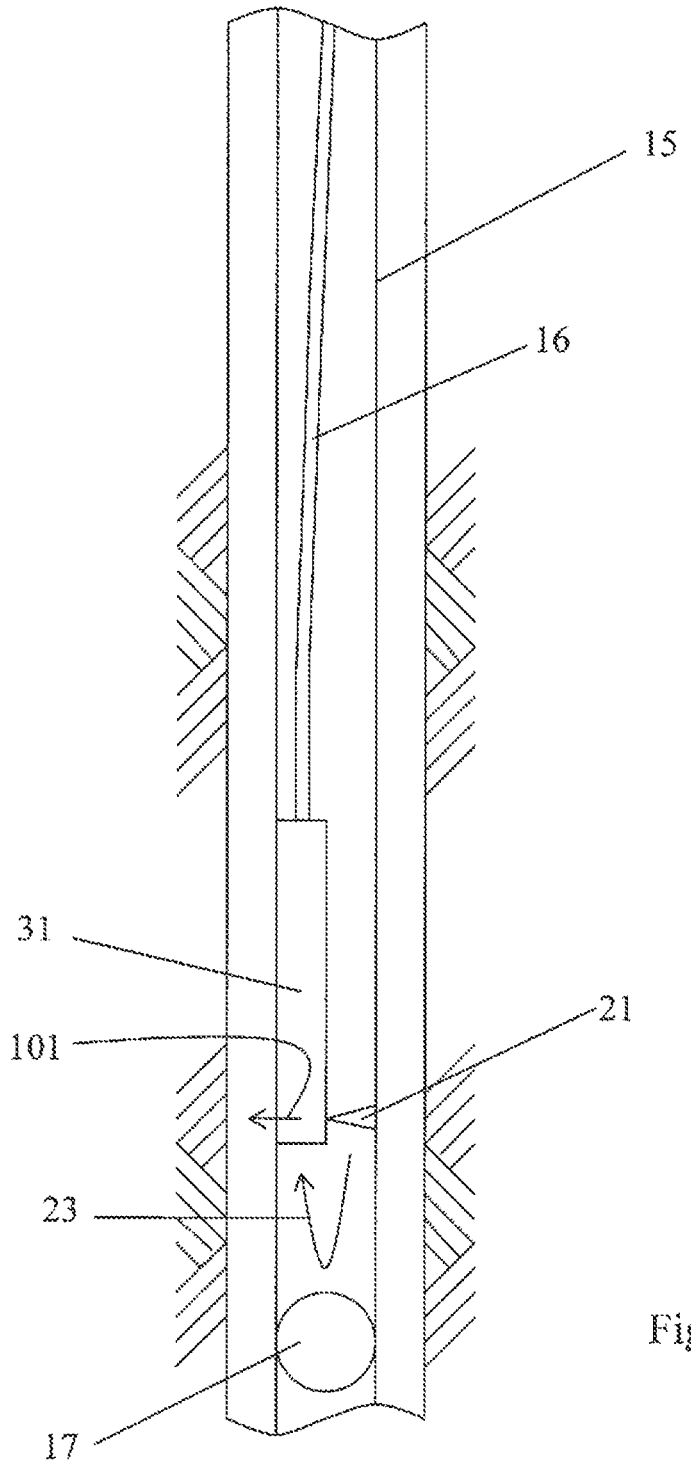

The operation and use of the perforating torch 31 and radial cutting torch 19 will now be described, using the example of plugged coiled tubing (tubular or tubing) 15. Referring to FIG. 6, the perforating tool 31 is utilized first, before the radial cutting torch 19 is used. The perforating tool 31 is lowered by way of a wireline 16, such as an electric wireline, into the tubular or tubing 15 that is to be cut. The perforating tool 31 can be located in contact with the closure 17, or can be located above the closure 17. Locating the perforating tool 31 in contact with the closure 17 increases the amount of tubular to be recovered, as the opening 103 (see FIG. 8) is located very close to the closure 17. It should be noted that in FIGS. 6-10, the perforating tool 31 is shown out of contact with the closure 17 to better illustrate the pressure waves. When the perforating tool 31 is in a set position for operation, an electrical signal is provided to the ignition source 41 (see FIGS. 2A and 2B), which ignites the pellets 55 and the combustible fuel material 57. The pressure and combustion fluids, produced by the fuel, force the nozzle head 38 out of the nozzle section 37, as shown in FIG. 3B. As the pressure and combustion fluids fill the internal cavity 62 of the nozzle head 38, well fluids are expelled from the nozzle section 37 through the nozzle opening 62. The combustion fluids 21 are directed out of the nozzle opening 62, as shown in FIG. 7.

Because the nozzle opening 62 is located on one side of the nozzle head 38, the combustion fluids 21 are directed in a first direction to that one side. The expulsion of combustion fluids 21 on the one side creates a reverse action, or reaction, force 101 which causes the perforating tool 31 to move in a second direction opposite to the first direction, as shown in FIG. 7. The reaction force 101 is such that the perforating tool 31 is held firmly against the inside diameter of the tubing 15 (see FIG. 7), even when the perforating tool 31 is subjected to a pressure wave 23. Thus, the perforating tool 31 is able to resist the reflected pressure wave 23 from the closure 17. This results in the perforating tool 31 being held at the same section of tubing 15 so that the combustion fluids 21 remain directed onto the same area of tubing 15. The combustion fluids 21 form an opening 103 in the tubing 15. FIG. 8 shows the opening 103, and the perforating tool 31 after the combustion fluids 21 have dissipated and the perforating tool 31 has returned to the center of the tubing 15.

Figure 9:
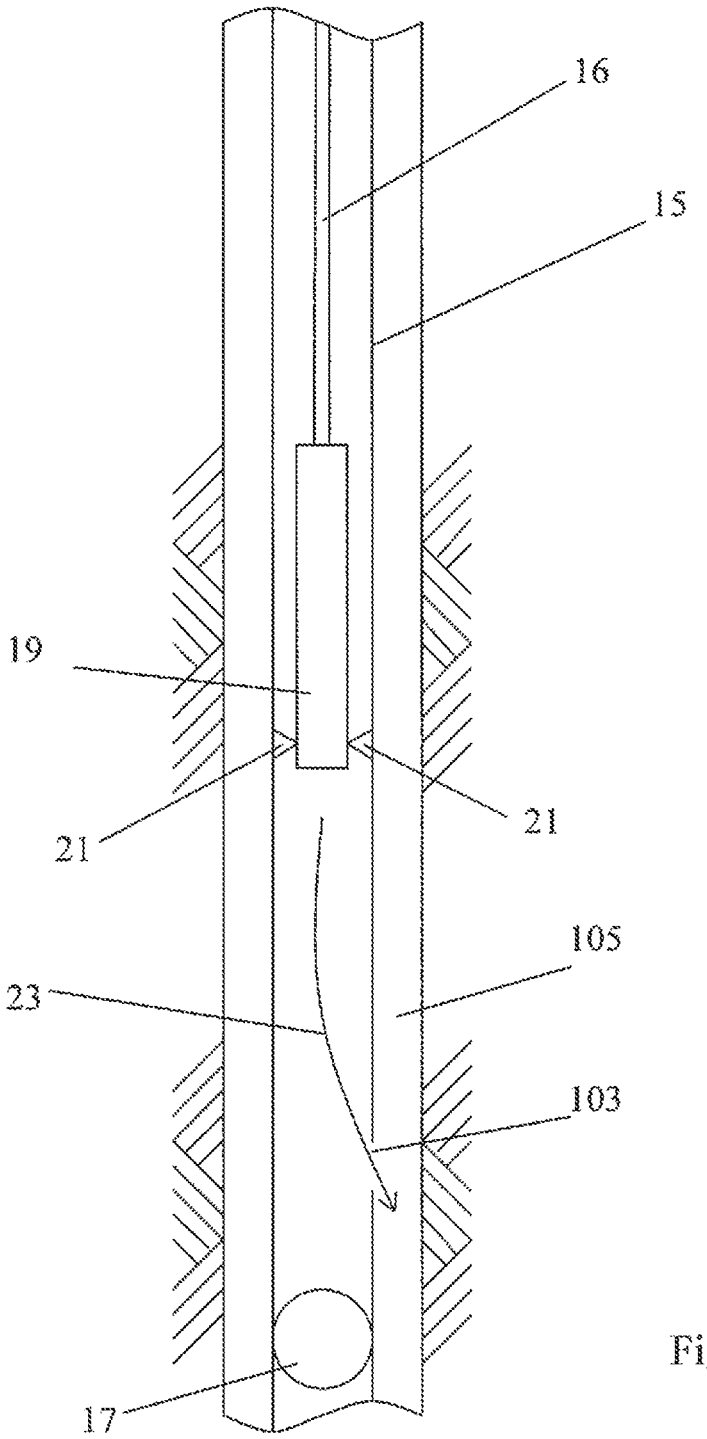

In one embodiment, the perforating tool 31 is then removed and replaced with the radial cutting torch 19, as shown in FIG. 9. The radial cutting torch 19 is positioned in the tubing above the opening 103. When the radial cutting torch 19 is operated, combustion fluids are produced in a 360 degree circumference around the tool. The pressure wave 23 is vented out of the tubing 15 through the opening 103. The pressure wave enters the annulus 105 where it is dissipated in both directions, but outside of the tubing 15. Some reflection of the pressure wave likely occurs at the opening 103, but the reflected pressure wave is too attenuated to adversely move the radial cutting torch 19. The combustion fluids 21 remain concentrated on one narrow band of the tubing, resulting in the tubing 15 being cut. The radial cutting torch 19 is then retrieved, followed by retrieval of the tubing above the cut.

The amount of reaction force needed on the perforating tool 31 may depend on the strength of the pressure wave 23 that impacts the perforating tool 31. The strength of the pressure wave 23 may be dependent upon several factors, such as the amount and type of fuel used. Another factor is the distance of the perforating tool 31 from the closure 17 and the clearance between the perforating tool 31 and the tubing 15. The closer the perforating tool 31 is placed to the closure 17, the stronger the pressure wave 23 that impacts the perforating tool 31 and the more likely the impact of the pressure wave 23 is to coincide at the same time that the combustion fluids 21 are cutting the tubular. The smaller the clearance between the outside diameter of the perforating tool 31 and the inside diameter of the tubing 15, the stronger the pressure wave 23, as the bulk of pressure wave 23 is encountered by the perforating tool 31 and not bypassed through the clearance. The density and makeup of the drilling fluids inside of the tubing 15 may also have a bearing on the pressure wave 23, as some drilling fluids are more efficient in propagating pressure waves. Additionally, the more energy required to form the tubular opening 103, the larger the pressure wave 23 is likely to be created, requiring a greater reaction force. A larger opening 103 and thicker tubular wall requires more energy from the combustion fluids to form the tubular opening 103. Thus, an opening 103 that requires a large amount of energy will likely have a larger pressure wave 23. The larger pressure wave 23 can be compensated for with a larger reaction force. A larger reaction force can be created by narrowing the arc A (see FIG. 4B) of the nozzle opening 62 or openings 69.

In one embodiment, after the perforating tool 31 is removed from the tubing 15, the nozzle section 37, including the nozzle head 38, may be detached from the perforating tool 31 and replaced with another nozzle section 37 having another nozzle head. That is, the nozzle section 37 may be detachably attached, e.g., by a threaded connection, to the fuel section 39, so that the nozzle section 37 may be easily detached from the fuel section 39. The other nozzle head may be different than the original nozzle head 38 by having a different arrangement or pattern of nozzle opening(s) 62. This process may be conducted at the well site or other locations. In other embodiments, the nozzle section 37 may be detachably attached from the fuel section 39 in order to replace or modify the fuel load, i.e., the pellets 55 and/or the combustible fuel material 57. Replacing the nozzle section 37 so that the perforating tool 31 has a different nozzle head may be advantageous if the different nozzle head is more suited to a particular perforating operation. Similarly, detaching the nozzle section 37 to replace or modify the fuel load may be advantageous if the different fuel load is more suited to a particular perforating operation. For instance, more pellets 55 may be added, or some of the existing pellets 55 may be removed. Alternatively, at least some of the pellets 55 may be removed and replaced with different pellets having a different composition than the existing pellets 55. The detachable nozzle section 37 provides the perforating tool 31 with a modularity that is beneficial when the perforating tool 31 is already in the field, making the perforating tool 31 adaptable to different perforating operations while in the field. For instance, the perforating tool 31 may be part of a kit that includes a variety of nozzle sections 37 having different nozzle heads 38 that are attachable to the fuel section 39 via, e.g., a threaded connection. The kit may also include a variety of different pellets that may replace existing pellets, or that may otherwise be added or inserted into the fuel section 39.

Figure 10:
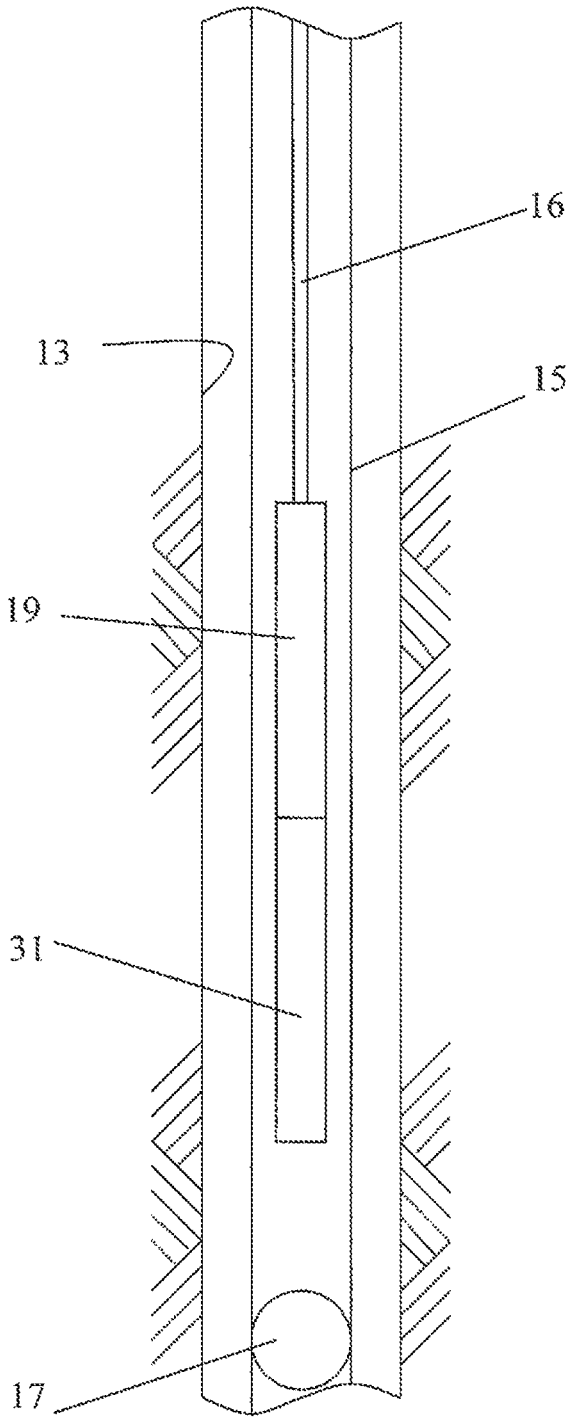
FIG. 10 illustrates the perforating tool and cutting torch in tandem, according to an embodiment.

FIG. 10 shows an embodiment having the perforating tool 31 and the radial cutting torch 19 located on the same wireline 16 together, in tandem. The perforating tool 31 and the radial cutting torch 19 are operated as described above with respect to FIGS. 6-9, except that the two tools are lowered together into the tubular 15. Thus, after operating the perforating tool 31 and creating an opening 103, the perforating tool 31 is not removed before operating the radial cutting torch 19. Instead, both tools are left down in the tubular 15 and the radial cutting torch 19 is operated to sever the tubular 15. Then both tools can be retrieved together. FIG. 10 shows the perforating tool 31 located below the radial cutting torch 19. In another embodiment however, the radial cutting torch 19 could be located below the perforating tool 31. Once the perforating tool 31 is operated, the radial cutting torch 19 can be positioned in the tubular 15 at the desired location. Thus, the radial cutting torch 19 can be raised or lowered in the tubular 15.

The perforating tool 31 has been described herein in conjunction with a cutting torch 19. However, the perforating tool 31 can be used without a cutting torch 19. For example, if a drill pipe or other tubular becomes stuck in a borehole, it may be desirable to create one or more large holes in the drill pipe to allow circulation. The perforating tool 31 may be used to create one or more large openings in the drill pipe. The perforating tool can be used close to and above the check valve or other closure 17 in the drill pipe. In this operation, the opening pattern in the nozzle head can be a relatively large circular opening or openings. The diameter of the opening(s) may be such that a backward reaction force is created to pin the perforating tool 31 against the drill pipe. The radial cutting torch 19 is not used in this scenario.

Furthermore, the perforating tool 31 can be used for correcting cement jobs. Typically, cement is pumped down inside casing to the bottom and then back up around the outside of the casing. On occasion, the cement around the outside of the casing has voids. The perforating tool 31 can be used to create an opening in the casing at the void. Once the opening is created, cement can be pumped down the inside of the casing, out through the opening and into the void. The perforating tool 31 can generate large openings which allow the cement to be pumped through at high volumes and high flow rates. In another instance, the perforating tool 31 can be used to create openings in tubular such as casing for introducing loss circulation materials into the borehole.

While various embodiments usable within the scope of the present disclosure have been described with emphasis, it should be understood that within the scope of the appended claims, the present invention can be practiced other than as specifically described herein.

What is claimed is:

1. An apparatus for perforating a downhole tubular, the apparatus comprising:

a fuel section having combustible material capable of producing cutting fluids;

an igniter section coupled to the fuel section and having an igniter that ignites the combustible material so as to produce cutting fluids and pressure; and a nozzle section being in communication with the fuel section and comprising a nozzle head located therein and adjacent the combustible material, wherein the nozzle head comprises an internal cavity and a nozzle portion including at least one opening on one side of the nozzle portion that directs the cutting fluids out of the internal cavity in a first radial direction to produce a reaction force on the apparatus in a second radial direction that is opposite to the first radial direction, the reaction force moving the apparatus in the second radial direction to be against an inner wall of the downhole tubular and temporarily anchoring the apparatus against the inner wall, and the nozzle head is movable via the pressure and the cutting fluids from a closed position within the nozzle section to an open position in which the nozzle head protrudes out of the nozzle section so that the at least one opening is disposed below the nozzle section to be exposed to the downhole tubular for directing the cutting fluids onto the downhole tubular.

2. The apparatus of claim 1, wherein there are at least two openings in the nozzle portion, the at least two openings being spaced circumferentially relative to each other, the at least two openings directing cutting fluids along parallel trajectories.

3. The apparatus of claim 1, wherein the nozzle section comprises an internal no-go shoulder, and the nozzle head comprises an outer shoulder that is configured to contact the internal no-go shoulder after the igniter ignites the combustible material to move the nozzle head relative to the nozzle section.

4. The apparatus of claim 1, wherein the nozzle head comprises at least one seal around a perimeter of the nozzle head.

5. The apparatus of claim 1, wherein the combustible material comprises one or more solid combustible materials.

6. The apparatus of claim 1, wherein the combustible material comprises a metal and an oxidizer.

7. The apparatus of claim 1, wherein the combustible material is in the form of a liquid or a gel.

8. A method of perforating a tubular having a closure, the method comprising:

positioning a perforator in the tubular within a distance to the closure, the perforator comprising a movable nozzle head located within a nozzle section, the movable nozzle head comprising an internal cavity and at least one opening on one side of the movable nozzle head;

operating the perforator to produce pressure and cutting fluids in the internal cavity to move at least a portion of the movable nozzle head out of the nozzle section so that the at least one opening is disposed below the nozzle section to be exposed to the tubular, and directing the cutting fluids in a first radial direction toward the tubular, wherein the production of cutting fluids produces a reaction force and a pressure wave in the tubular that is reflected off of the closure and back to the perforator;

moving the perforator via the reaction force to be against the tubular;

temporarily anchoring the perforator against the tubular while the reflected pressure wave impinges on the perforator;

continuing to produce cutting fluids in the first radial direction, while the perforator is anchored against the tubular by the reaction force, to create an opening in the tubular;

positioning a radial cutter in the tubular within the distance to the closure, with the opening located between the radial cutter and the closure; and operating the radial cutter to radially cut the tubular.

9. The method of claim 8, wherein the reaction force is a predetermined reaction force having a magnitude that is based on the distance of the perforator from the closure.

10. The method of claim 8, wherein the reaction force is a predetermined reaction force having a magnitude that is based on a clearance between the perforator and the tubular.

11. The method of claim 8, wherein the tubular has a drilling fluid with a density, and the reaction force is a predetermined reaction force having a magnitude that is based on the density of the drilling fluid.

12. The method of claim 8, wherein the tubular has a wall thickness, and the opening has a size, and the reaction force is a predetermined reaction force having a magnitude that is based on the tubular wall thickness and the size of the opening.

13. The method of claim 8, wherein the nozzle section comprises an internal no-go shoulder, and the nozzle head comprises an outer shoulder, and the outer shoulder contacts the internal no-go shoulder after the nozzle head is moved a predetermined distance relative to the nozzle section to prevent the nozzle head from completely exiting the nozzle section.

14. The method of claim 8, wherein the nozzle head is a first nozzle head, and the method further comprises replacing the first nozzle head with a second nozzle head after creating the opening.

15. The method of claim 14, wherein the second nozzle head includes a different opening than the at least one opening of the first nozzle head.

16. An apparatus for cutting a downhole tubular, comprising:

a perforating tool comprising:

a perforating igniter section;

a perforating fuel section; and a perforating nozzle section, wherein the perforating fuel section contains a first combustible material capable of producing pressure and cutting fluids, the perforating igniter section contains an igniter that ignites the first combustible material so as to produce cutting fluids, the perforating nozzle section is in communication with the perforating fuel section and comprises a nozzle head including an internal cavity and a nozzle portion that includes an opening on one side of the nozzle portion that directs the cutting fluids out of the internal cavity in a first radial direction to produce a reaction force on the perforating tool in a second radial direction that is opposite to the first radial direction, the reaction force moving the perforating tool in the second radial direction to be against an inner wall of the downhole tubular and temporarily anchoring the perforating tool against the inner wall, and the nozzle head is movable via the pressure and the cutting fluids from a closed position within the nozzle section to an open position in which the nozzle head protrudes out of the nozzle section so that the opening is disposed below the nozzle section to be exposed to the downhole tubular for directing the cutting fluids onto the downhole tubular; and a cutting torch comprising:

a cutting igniter section;

a cutting fuel section; and a cutting nozzle section, wherein the cutting fuel section contains a second combustible material capable of producing cutting fluids, wherein the cutting igniter section comprises a second igniter that ignites the second combustible material in the cutter fuel section, and wherein the cutting nozzle section is in communication with the cutting fuel section for discharging the cutter cutting fluids radially outward.

17. The apparatus of claim 16, wherein the first combustible material and the second combustible material are the same combustible material.

18. The apparatus of claim 16, wherein at least one of the first combustible material and the second combustible material is in the form of a solid, a liquid, or a gel.

19. The apparatus of claim 16, wherein at least one of the first combustible material and the second combustible material comprise a metal and an oxidizer.

* * * * *